US009518756B2

(12) United States Patent
Brown et al.

(10) Patent No.: US 9,518,756 B2
(45) Date of Patent: Dec. 13, 2016

(54) EXTERNAL RIB CAGE FOR AN INFLATABLE AIR DUCT

(75) Inventors: Robert Brown, Asbury, IA (US); Kevin J. Gebke, Dubuque, IA (US); Frank Heim, Platteville, WI (US); Michael A. Jacobson, Dubuque, IA (US); Nicolas B. Paschke, Milwaukee, WI (US); Cary Pinkalla, Fox Point, WI (US)

(73) Assignee: RITE-HITE HOLDING CORPORATION, Milwaukee, WI (US)

( * ) Notice: Subject to any disclaimer, the term of this patent is extended or adjusted under 35 U.S.C. 154(b) by 1350 days.

(21) Appl. No.: 11/560,123

(22) Filed: Nov. 15, 2006

(65) Prior Publication Data

US 2008/0113610 A1 May 15, 2008

(51) Int. Cl.
*F24F 7/00* (2006.01)
*F24F 13/02* (2006.01)

(52) U.S. Cl.
CPC ..... *F24F 13/0218* (2013.01); *F24F 13/0254* (2013.01)

(58) Field of Classification Search
CPC .. F24F 13/0218; F24F 13/0254; F16L 11/122; F16L 3/14; E21F 1/04
USPC ..... 454/298, 292, 296, 297, 306; 248/61
See application file for complete search history.

(56) References Cited

U.S. PATENT DOCUMENTS 1,244,465 A * 10/1917 Braly ..... 248/61
1,261,008 A * 4/1918 Braly ..... 138/107
1,440,814 A * 1/1923 Bins ..... F16L 31/00 285/260
1,833,704 A * 11/1931 Bins ..... E21F 1/04 138/107
1,838,623 A 12/1931 Hersey, Jr. et al.
1,986,861 A * 1/1935 Starr ..... 248/62
2,003,732 A * 6/1935 Bins ..... E21F 1/06 138/107
2,091,265 A * 8/1937 Brown ..... 138/107
2,122,925 A * 7/1938 Bins ..... E21F 1/06 248/61

(Continued)

FOREIGN PATENT DOCUMENTS

CA 2421334 9/2004
EP 899519 A1 * 3/1999
FR 2742523 6/1997

OTHER PUBLICATIONS

International Searching Authority, "International Search Report", for counterpart PCT Application No. PCT/US2007/080195 mailed on Feb. 7, 2008 (6 pages).

(Continued)

*Primary Examiner* — Gregory Huson
*Assistant Examiner* — Martha Becton
(74) *Attorney, Agent, or Firm* — Hanley, Flight & Zimmerman, LLC

(57) ABSTRACT

An external suspension system for supporting an inflatable air duct includes a series of external hangers that help hold the duct open while the duct is deflated. In some embodiments, the suspension system supports the duct at a series of points that are broadly distributed in a staggered pattern across the duct, yet the entire duct can be suspended from a single overhead cable, even if the duct is a stepped tube with multiple diameters. The system includes novel ways of locking the hangers to the duct and to the overhead cable.

20 Claims, 11 Drawing Sheets

(56) References Cited

U.S. PATENT DOCUMENTS

| | | | | |
|---|---|---|---|---|
| 2,222,497 | A | 11/1940 | Bins | |
| 2,804,095 | A * | 8/1957 | Schauenburg | E21F 1/04 138/107 |
| 2,857,108 | A * | 10/1958 | Wallace | 237/53 |
| 3,194,590 | A * | 7/1965 | Cook | 285/61 |
| 3,357,088 | A * | 12/1967 | Hoffman et al. | 29/432 |
| 3,478,667 | A * | 11/1969 | Bourquin | 454/296 |
| 3,823,652 | A * | 7/1974 | Lambert | 454/306 |
| 3,933,377 | A * | 1/1976 | Arrowood | F16L 21/005 248/62 |
| 5,137,057 | A * | 8/1992 | Hummert, III | F16L 11/04 138/106 |
| 5,285,818 | A * | 2/1994 | Hummert, III | 138/107 |
| 5,429,330 | A * | 7/1995 | Bond et al. | 248/61 |
| 5,769,708 | A * | 6/1998 | Paschke | 454/306 |
| 6,280,320 | B1 | 8/2001 | Paschke | |
| 6,558,250 | B1 * | 5/2003 | Paschke | F16L 55/02718 454/306 |
| 2005/0211851 | A1 * | 9/2005 | Caminita, Jr. | 248/58 |

OTHER PUBLICATIONS

International Searching Authority, "Written Opinion of the International Searching Authority", for counterpart PCT Application No. PCT/US2007/080195 mailed on Feb. 7, 2008 (6 pages).

International Bureau, "International Preliminary Report on Patentability," issued in connection with counterpart international application No. PCT/US2007/080195, issued May 19, 2009, 7 pages.

Australian Patent Office, "First Examination Report," issued in connection with Australian application serial No. 2007319647, issued Mar. 1, 2010, 7 pages.

State Intellectual Propert Office of China P.R., "First Office Action," with English translation, issued in connection with Chinese application serial No. 200780042130X, issued Aug. 23, 2010, 6 pages.

Canadian Intellectual Propery Office, "Office Communication," issued in connection with Canadian application serial No. 2,669,337, mailed Dec. 29, 2010, 4 pages.

Australian Patent Office, "Notice of Acceptance," issued in connection with Australian application serial No. 2007319647, issued Oct. 14, 2010, 3 pages.

Chinese Intellectual Property Office, "Second Office Action," issued in connection with Chinese Application No. 200780042130.X, mailed on Apr. 19, 2012, 4 pages.

Indian Patent Office, "First Examination Report", issued in connection with Indian patent application No. 3153/DELNP/2009, Mar. 20, 2015, 2 pages.

* cited by examiner

EXTERNAL RIB CAGE FOR AN INFLATABLE AIR DUCT

FIELD OF THE DISCLOSURE

The present disclosure generally pertains to inflatable air ducts and more specifically to a support system for such a duct.

BACKGROUND OF RELATED ART

Ductwork is often used for conveying conditioned air (e.g., heated, cooled, filtered, etc.) discharged from a fan and distributing the air to a room or other areas within a building. Ducts are typically formed of rigid metal, such as steel, aluminum, or stainless steel. In many installations, ducts are hidden above suspended ceilings for convenience and aesthetics. But in warehouses, manufacturing plants and many other buildings, the ducts are suspended from the roof of the building and are thus exposed. In those warehouse or manufacturing environments where prevention of air-borne contamination of the inventory is critical, metal ducts can create problems.

For instance, temperature variations in the building or temperature differentials between the ducts and the air being conveyed can create condensation on both the interior and exterior of the ducts. The presence of condensed moisture on the interior of the duct may form mold or bacteria that the duct then passes onto the room or other areas being supplied with the conditioned air. In the case of exposed ducts, condensation on the exterior of the duct can drip onto the inventory or personnel below. The consequences of the dripping can range anywhere from a minor irritation to a dangerously slippery floor or complete destruction of products underneath the duct (particularly in food-processing facilities).

Further, metal ducts with localized discharge registers have been known to create uncomfortable drafts and unbalanced localized heating or cooling within the building. In many food-processing facilities where the target temperature is 42 degrees Fahrenheit, a cold draft can be especially uncomfortable and perhaps unhealthy.

Many of the above problems associated with metal ducts are overcome by the use of flexible fabric ducts, such as a Frommelt DUCTSOX. Such ducts typically have a flexible fabric wall (often porous) that inflates to a generally cylindrical shape by the pressure of the air being conveyed by the duct. Fabric ducts seem to inhibit the formation of condensation on its exterior wall, possibly due to the fabric having a lower thermal conductivity than that of metal ducts. In addition, the fabric's porosity and/or additional holes distributed along the length of the fabric duct broadly and evenly disperse the air into the room being conditioned or ventilated. The even distribution of airflow also effectively ventilates the walls of the duct itself, thereby further inhibiting the formation of mold and bacteria.

In many cases, however, once the room's conditioning demand has been met, the air supply fan is turned off or down until needed again. When the fan is off, the resulting loss of air pressure in the duct deflates the fabric tube, causing it to sag. Depending on the application and material of the fabric, in some cases, the sagging creates a poor appearance or may interfere with whatever might be directly beneath the duct. Moreover, when the duct is re-inflated, the duct can produce a loud popping sound as the duct's fabric becomes taut.

To eliminate or reduce the sagging and popping noise, some inflatable ducts include structure that helps hold a deflated duct in a generally expanded shape. Examples of ducts supported in such a manner are disclosed in U.S. Pat. Nos. 6,280,320 and 3,357,088. A significant drawback of the patented systems is the amount of supporting hardware necessary to keep the duct expanded. For the air duct of the '320 patent, various embodiments include two parallel support channels (FIGS. 1-9), an assembly comprising numerous components (items 80, 94, 74, 82, and 84 of FIG. 12), or large cumbersome hoops (FIGS. 13 and 14).

For the air duct of the '088 patent, the support structure is similar to a triangular coat hanger comprising three structural bars (items 19, 20 and 21). Bar (21) of the '088 patent extends through the interior of the duct, which can disrupt the airflow. The '088 device also includes grommets 23 through which the structural bars extend. If the holes in the grommets are too big, the grommets may slide around the structural bars, which would allow the duct to sag. If the holes in the grommets are too small, the resulting tight fit between the grommets and the structural bars would make it more difficult to remove the bars for periodic laundering of the fabric duct.

Consequently, a need exists for a simple, lightweight structure that can support a deflated duct in a generally expanded shape.

SUMMARY

In some embodiments, an air duct assembly includes an inflatable tube supported at a plurality of points that are distributed along the tube in a staggered, alternating pattern.

In some embodiments, an inflatable air duct is supported by a series of hangers that do not extend into the duct.

In some embodiments, an inflatable air duct is supported by a series of hangers, wherein each hanger has two ends that connect to a pair of radially displaced points on the duct. The two ends are separated by the interior of the duct so as not to interfere with airflow through the duct.

In some embodiments, an inflatable air duct is externally supported such that its deflated volume is at least 70% fits inflated volume. In some embodiments, an inflatable air duct with stepped diameters is supported by a single suspension line.

In some embodiments, spaced lateral supports are suspended from a support structure above the inflatable tube and are each connected to laterally spaced points on the tube.

DETAILED DESCRIPTION

Referring to FIGS. 1-6, an HVAC system for heating, ventilating or air conditioning includes an air duct assembly 10 with an inflatable tube 12 made of a pliable material that encloses an air passageway 14. Tube 12 is connected to receive pressurized air from a blower 16 or some other source and distribute that air within a building or wherever the air may be needed. To disperse the air from within the tube's air passageway 14, tube 12 can be made of an air permeable material and/or tube 12 may be provided with a series of holes or air registers.

For the HVAC system to meet the demand for air, blower 16 can be periodically energized and de-energized as needed. When energized, blower 16 inflates tube 12 to a generally cylindrical shape (or some other closed shape) as shown in FIGS. 1, 3, 5 and 6. Once the need for air has been satisfied, de-energizing blower 16 causes tube 12 to deflate to the shape shown in FIG. 4.

Figure 4:
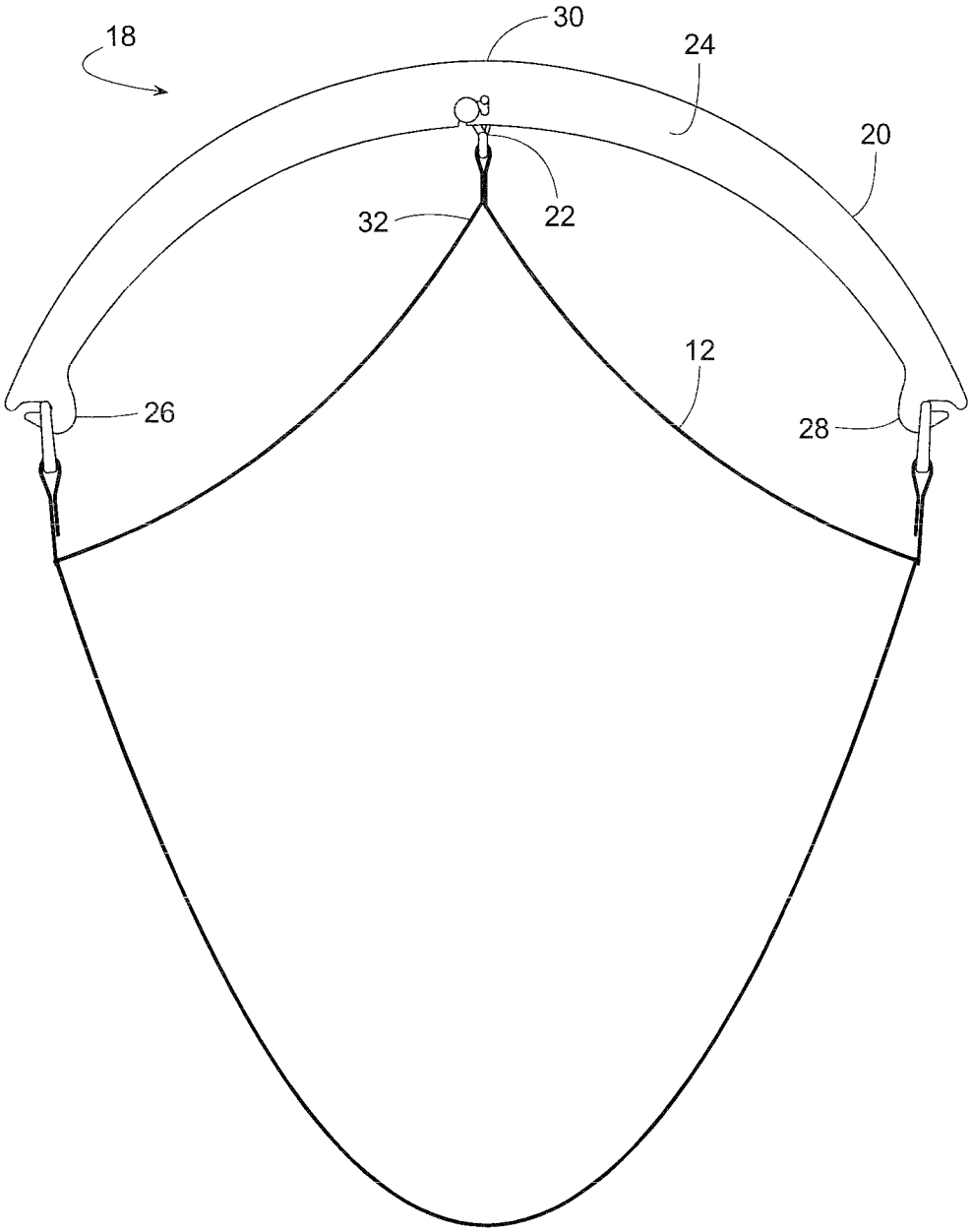
FIG. 4 is a cross-sectional view similar to FIG. 3 but showing the tube deflated.
Figure 5:
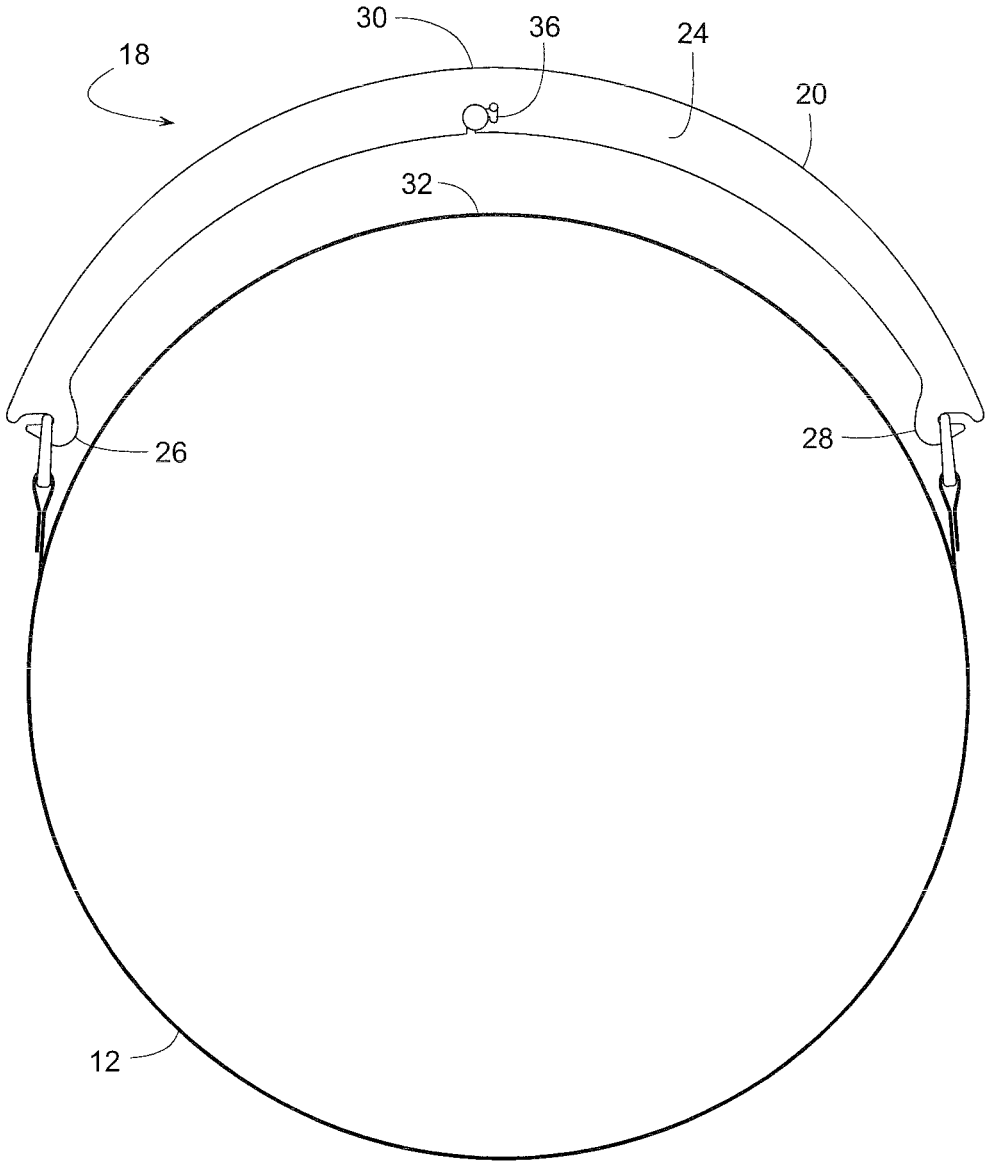
FIG. 5 is a cross-sectional view taken along line 5-5 of FIG. 1.
Figure 6:
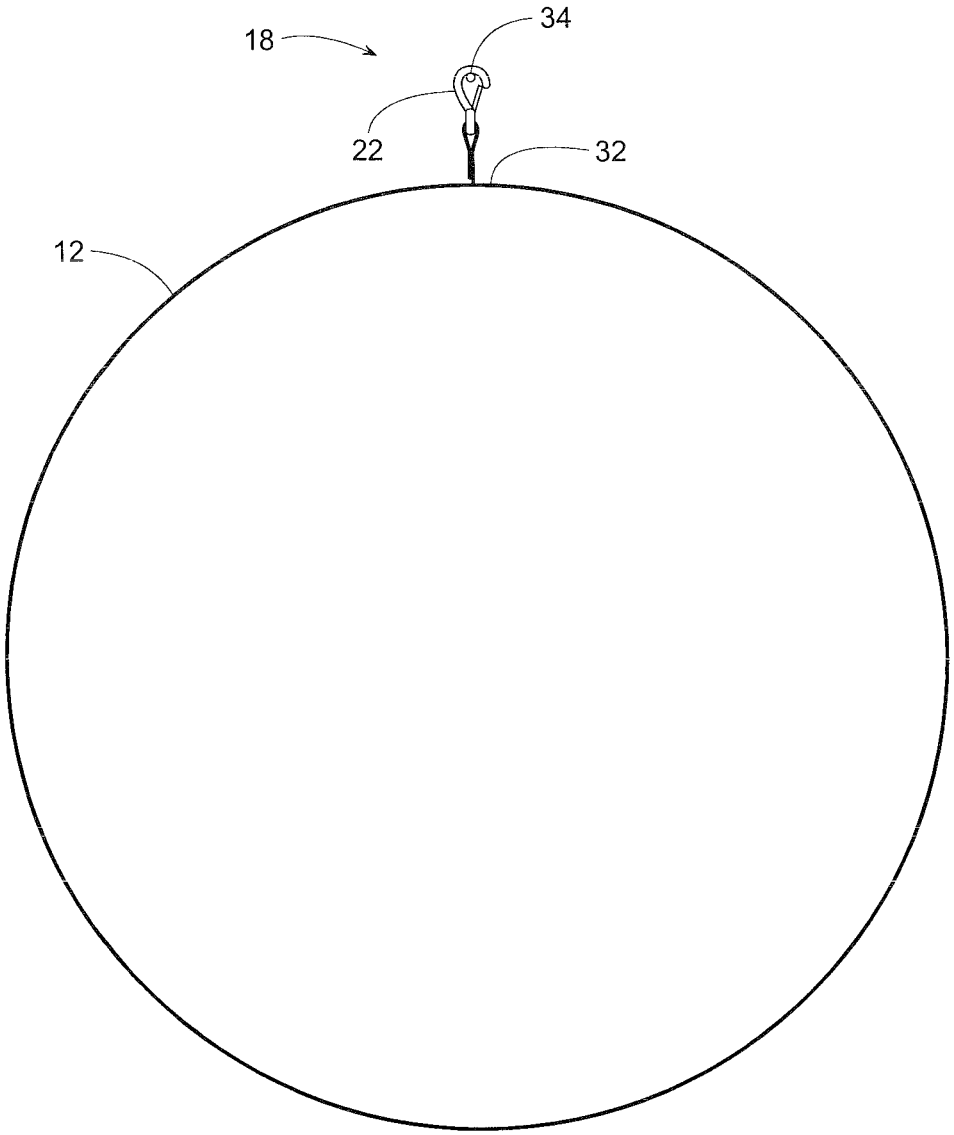
FIG. 6 is a cross-sectional view taken along line 6-6 of FIG. 1.

As tube 12 changes between its inflated and deflated shapes, it is desirable to minimize the amount that tube 12 sags, minimize the duct's change in volume, and/or minimize a popping sound when tube 12 suddenly inflates. To accomplish one or more of these goals, a suspension system 18 comprising a plurality of hangers 20 and a plurality of connectors 22 may be used to help hold the deflated tube in a generally expanded shape, as shown in FIG. 4.

Although the actual design of hangers 20 may vary, in one embodiment, each hanger 20 comprises an arcuate arm 24 made of ⅛" thick sheet metal, which is more rigid than the material of tube 12. In this example, each hanger 20 includes a first termination point 26, a second termination point 28 and an intermediate termination point 30. Termination points 26 and 28 are coupled to tube 12 at approximately 10:00 and 2:00 positions, and intermediate point 30 is at about a 12:00 position coupled to a top central portion 32 of tube 12.

Figure 7:
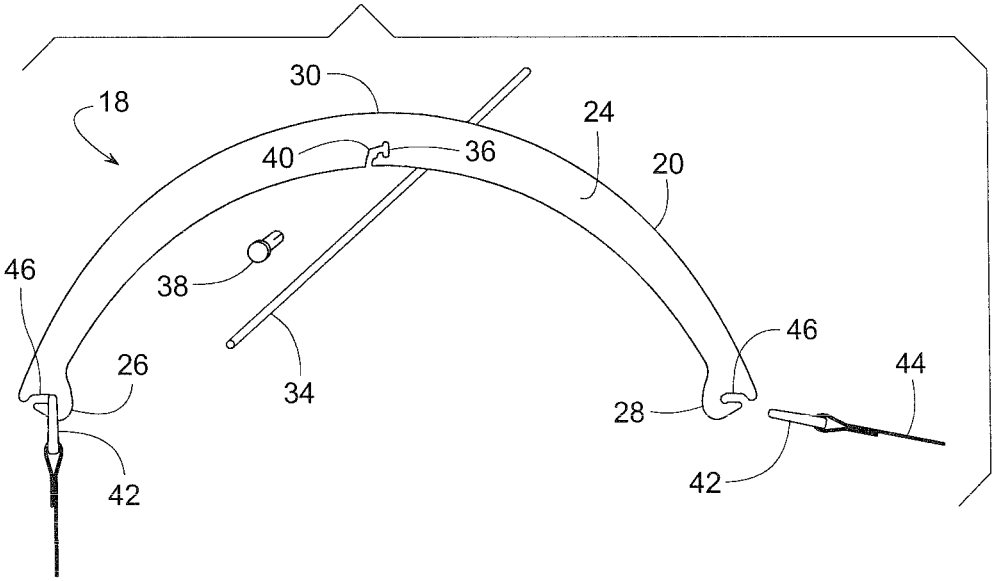
FIG. 7 is an exploded perspective view of a hanger and related hardware.
Figure 8:
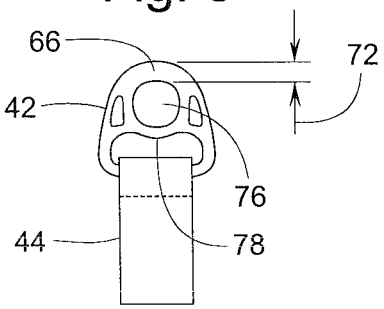
FIG. 8 is a front view of a D-ring.
Figure 9:
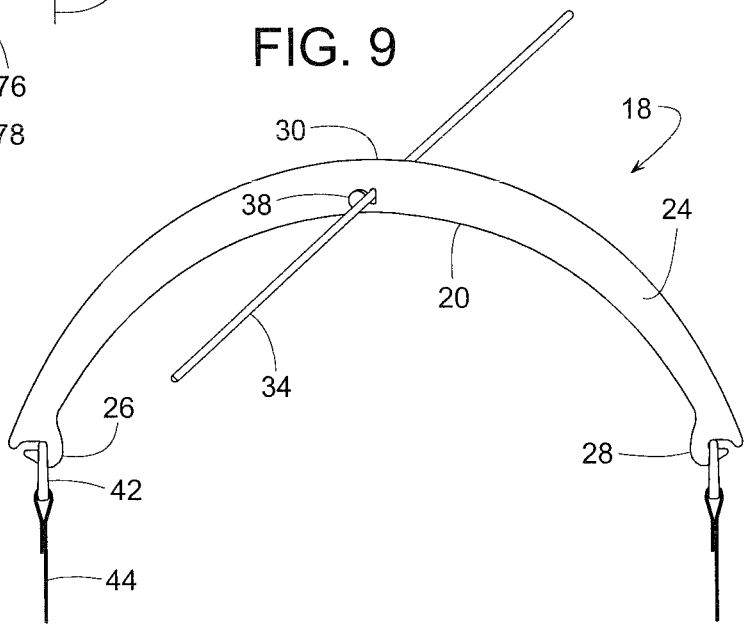
FIG. 9 is a perspective view showing a hanger assembly.
Figure 10:
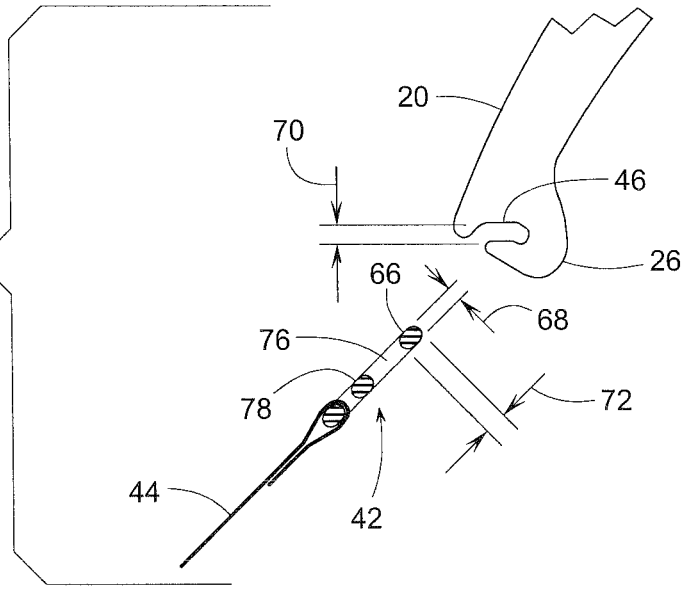
FIG. 10 is front view of a hanger showing a D-ring about to be inserted into a slot of a hanger.
Figure 11:
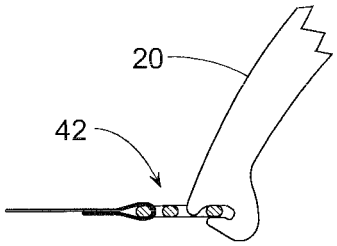
FIG. 11 is a front view similar to FIG. 10 but showing the D-ring being inserted into the hanger's slot.
Figure 12:
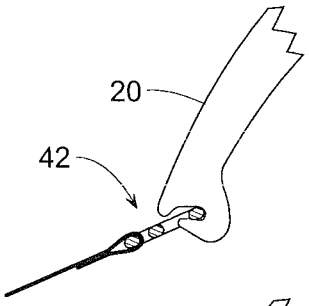
FIG. 12 is a front view similar to FIGS. 10 and 11 but showing the D-ring being rotated into position.
Figure 13:
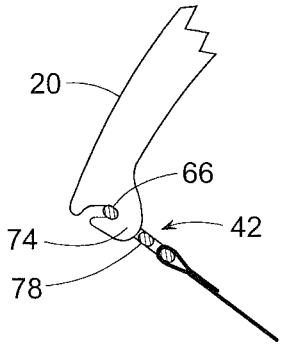
FIG. 13 is a front view similar to FIGS. 10-12 but showing the D-ring in its final position within the hanger's slot.

Hangers 20 can be supported by any suitable support structure including, but not limited to, a ceiling; joist; beam; bracket; or in the case of one example, an overhead suspension line 34 such as a cable, cord, wire, chain, rope, strap or elongate bar. In general, hangers 20 would be suspended from the support structure along a line generally collinear with the longitudinal extent of the tube 12, or a portion thereof. One of skill in the art will appreciate that the hangers will likely not be connected to the support structure along a strict geometric line given variation in the building, etc. Even so, the combination of the support structure and spaced hangers can be thought of as defining a longitudinal support (i.e. extending along the longitude of the tube 12) with space lateral (i.e. generally extending perpendicular to the longitude of the tube) supports attachable to the exterior of tube 12. Perhaps the clearest example of this description of the depicted structure is the embodiment of FIG. 18, in which line 34 represents the longitudinal support and hangers 62, 64 represent the spaced lateral supports, In the case of the hangers being attached to other structure (ceiling joists, beams, etc.) the longitudinal support may not have a continuous longitudinal extent like line 34. Returning to FIGS. 7, 8 and 9, to connect hanger 20 to suspension line 34, hanger 20 can be provided with a line-receiving slot 36 near intermediate point 30. Slot 36 can have a shape that helps prevent line 34 from readily escaping, and/or a stopper 38 can be added to help hold line in place. Stopper 38, for example, can be a plastic plug that snaps into a mating detent 40 in slot 36. Another way of connecting hanger 20 to line 34 includes, but is not limited to, adding a link, fastener or coupling between hanger 20 and line 34.

Figure 1:
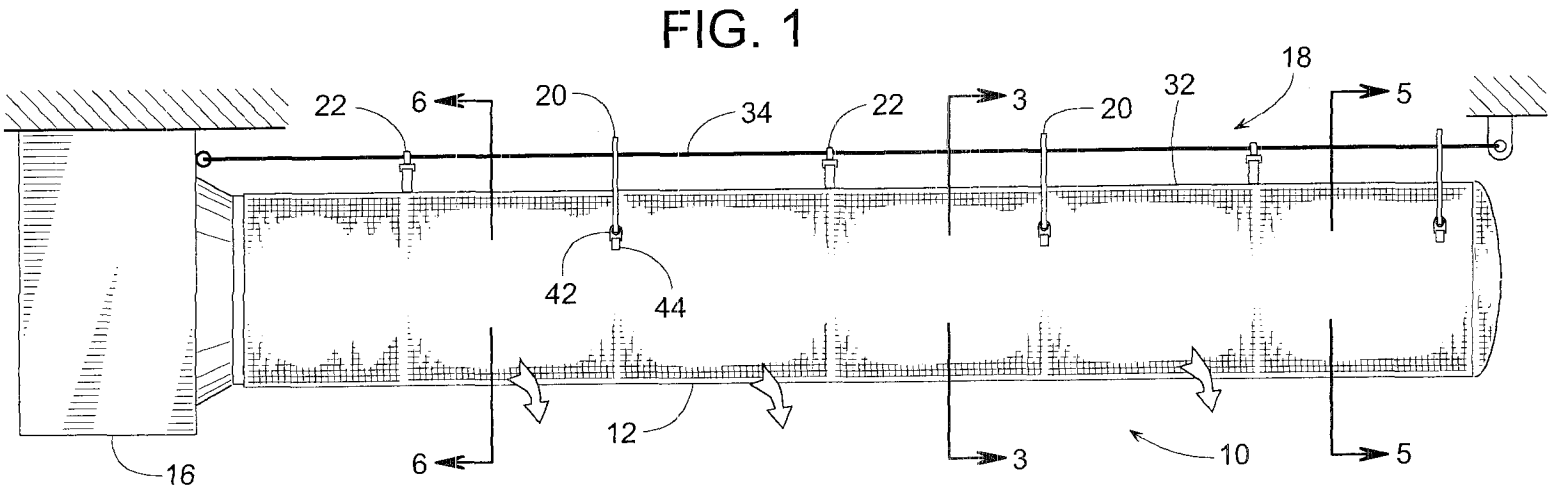
FIG. 1 is a side view of an inflated air duct assembly that includes a novel suspension system.
Figure 2:
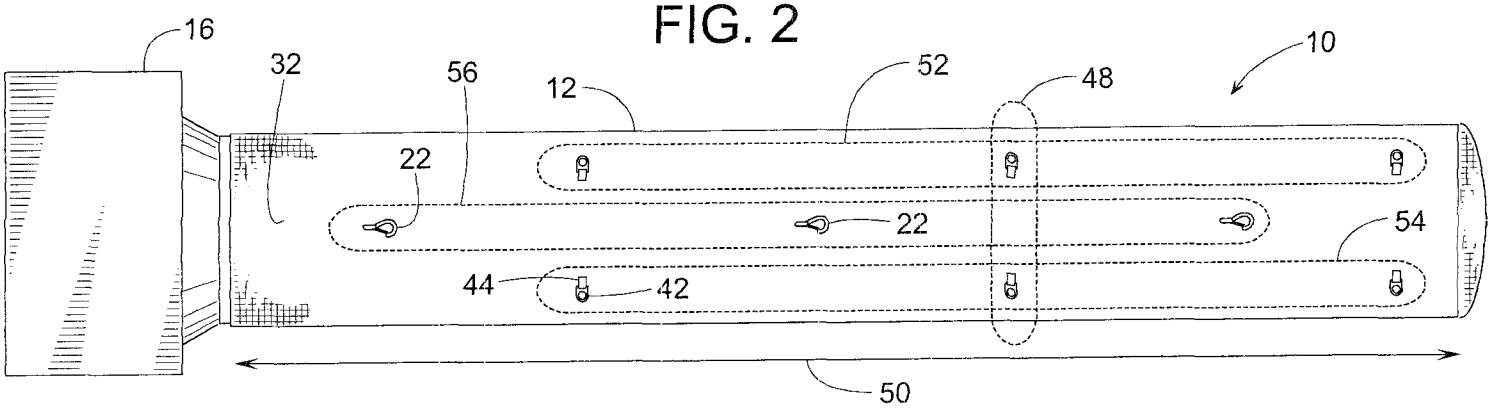
FIG. 2 is a top view of FIG. 1 but with the suspension system's hangers, connectors, and suspension line omitted to more clearly show other features.
Figure 3:
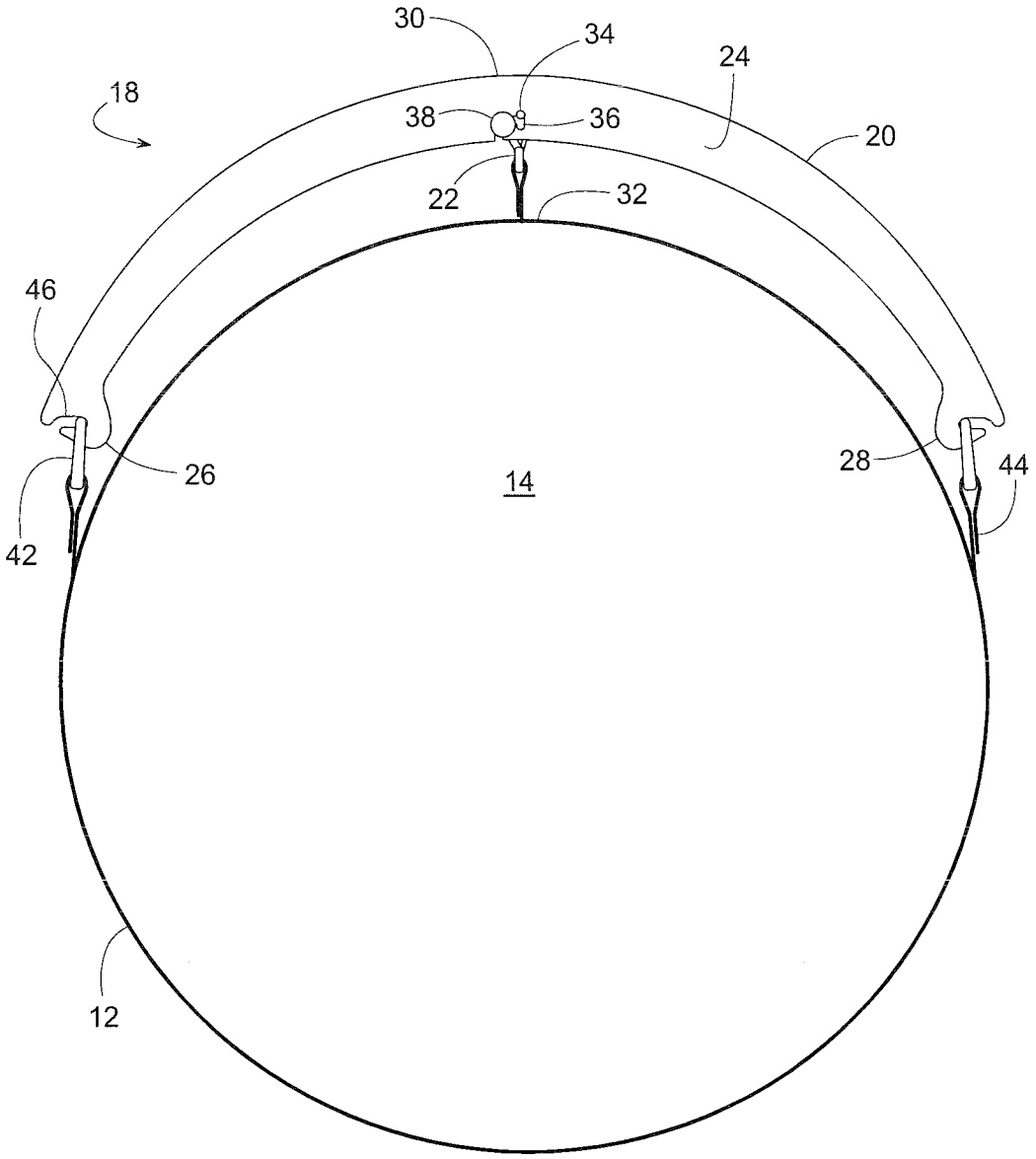
FIG. 3 is a cross-sectional view taken along line 3-3 of FIG. 1.

Termination points 26 and 28 can be coupled to tube 12 in any number of ways. In a one embodiment, a plastic D-ring 42 with a short fabric strap 44 can be used. Strap 44 can be sewn, riveted or bonded to tube 12 or attached to tube 12 in some other way. D-ring 42 can be inserted into a slot 46 in hanger 20. To help hold D-ring 42 in place, the shape of slot 46 and the surrounding sheet metal material can be such that D-ring 42 needs to be rotated about 90 degrees in order to insert or remove D-ring 42 from within slot 46. Each hanger 20 can be provided with two D-rings 42 so that each hanger 20 can be connected to a pair of points 48 on tube 12 (FIG. 2).

FIGS. 10-13 illustrate one way of inserting and holding D-ring 42 into slot 46 of hanger 20. In this example, D-ring 42 has a bar 66 that fits into slot 46. Bar 66 has a thickness 68 that is approximately equal to a width 70 of slot 46, which makes is easy to insert bar 66 into slot 46 and slide the bar from the position of FIG. 11 to that of FIG. 12. A width 72 of bar 66, however, is slightly greater than the slot's width 70, so bar 66 tightly binds within slot 46 as D-ring 42 is rotated from the position of FIG. 12 to that of FIG. 13. To further ensure that D-ring 42 stays within slot 46, hanger 20 includes a protrusion 74 that nearly fills a gap 76 between bar 66 and a second bar 78 of D-ring 42, thus bar 66 cannot slide straight back out of slot 46 without first counter-rotating D-ring 42 back to its position of FIG. 11.

Figure 14:
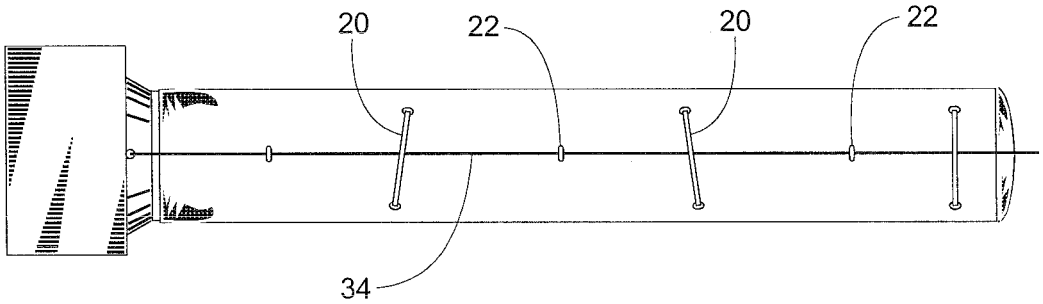
FIG. 14 is a top view showing a series of hangers that connect to an inflatable air duct at points that are slightly misaligned.

Hangers 20 can be distributed at spaced-apart intervals along line 34 to evenly support tube 12 along the tube's length 50 (longitudinal length or lengthwise direction). The face of hanger 20 may lie generally perpendicular to line 34 to provide hanger 20 with beam strength. D-rings 42 can couple first termination point 26 to a first lateral set of points 52 on tube 12 and couple second termination points 28 to a second lateral set of points 54. In some cases, lateral points 52 and 54 are substantially aligned in registry with each other, as shown in FIG. 2. In other cases, due to manufacturing or other inaccuracies, points 52 and 54 may be weak positioned somewhat out of registry with each other, as shown in FIG. 14. This is not a problem, however, as hangers 20 are self-aligning in that they have the freedom to pivot about a vertical axis relative to line 34, thereby compensating for the misalignment of points 52 and 54. In an embodiment in which hangers 20 are suspended from other structure—such as dealings, joists, beams, etc—similar compensation can be provided for. In that instance, the hangers 20 would be suspended from such structure by a connector that would give them the necessary freedom of movement to allow such mis-registry compensation. Examples of such connectors include cables and swiveling or pivoting connectors.

Figure 15:
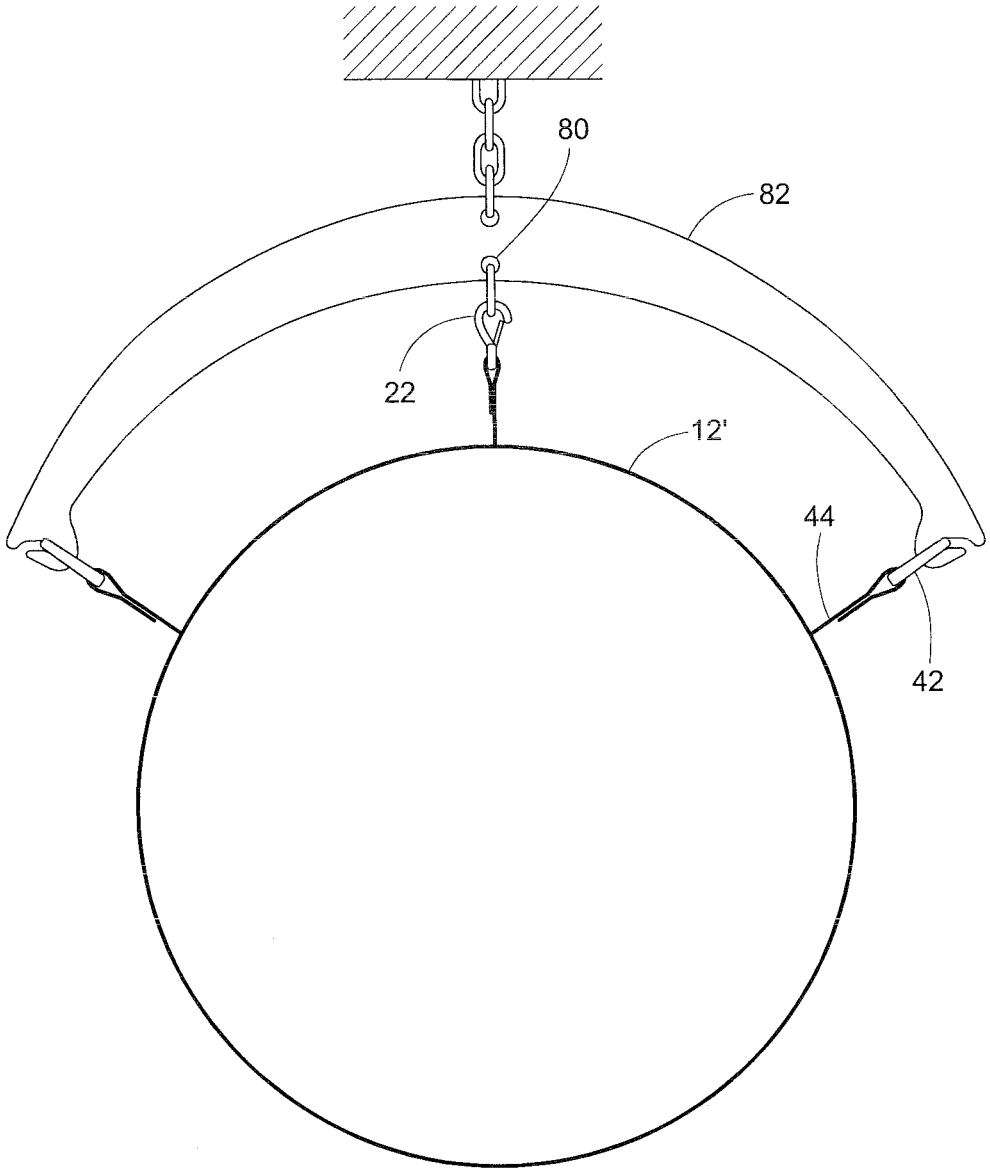
FIG. 15 is a view similar to FIG. 5 but showing a hanger that connects to the air duct at three points.

Although hangers 20 can be used alone, the addition of optional connectors 22 provide tube 12 with additional support. In some embodiments, connectors 22 are installed between hangers 20 in an alternating pattern along suspension line 34. They could also be attached directly to the ceiling joists, beams or other longitudinal support as referred to above. In other embodiments, as shown in FIG. 15, connectors 22 can be connected to a central point 80 of a slightly modified hanger 82. In either case, connectors 22 can be anything suitable for coupling a longitudinal support such as line 34 or hanger 82 to a central set of points 56 on the top central portion 32 of tube 12 or a tube 12'. Examples of connector 22 include, but are not limited to, a hook, clip, link, loop, ring, etc. The embodiment of FIG. 15 also illustrates that strap 44 holding D-ring 42 can extend radially or at any angle relative to the exterior surface of tube 12 or 12'.

Figure 16:
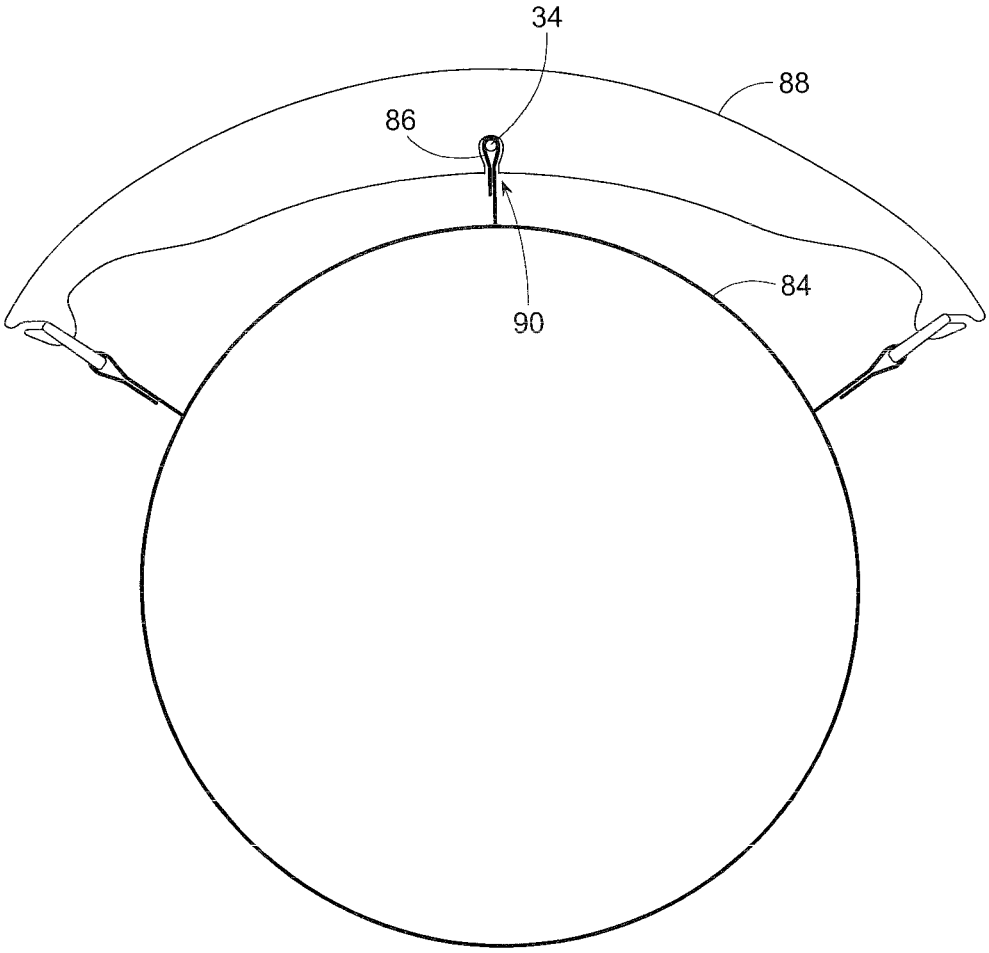
FIG. 16 is a view similar to FIG. 15 but showing an alternate hanger.

In another embodiment, shown in FIG. 16, suspension line 34 can be an integral part of an inflatable tube 84 by inserting line 34 within a fabric loop 86 that extends a full or partial length of tube 84. A slightly modified hanger 88 can be provided with a central notch 90 that snaps over or otherwise attaches to line 34 and/or loop 86.

Figure 17:
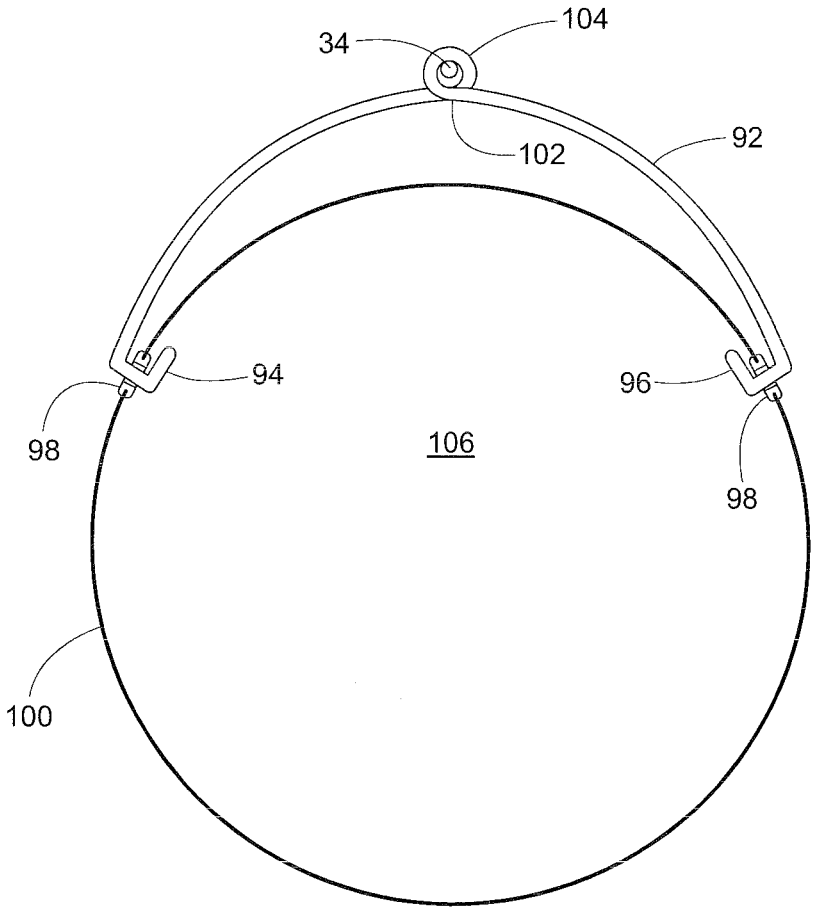
FIG. 17 is a view similar to FIG. 5 but showing an alternate suspension system.

In yet another embodiment, shown in FIG. 17, a wire hanger 92 includes a first termination point 94 and a second termination point 96 that hook into corresponding grommets 98 in an inflatable tube 100. Hanger 92 includes an intermediate point 102 with a coiled loop 104 that wraps around suspension line 34. An air passageway 106 separate points 94 and 96. An advantageous feature of this design is that tube 100 can be removed from hanger 92 while the hangers remain attached to line 34. Other embodiments depicted herein share the same feature. In this embodiment, connectors 22 can be added for additional support if necessary.

With various embodiments of duct assembly 10, excellent results have been achieved when the central set of points 56 are staggered out of registry with the lateral set of points 52 and 54, as shown in FIG. 2. This particular arrangement of points 52, 54 and 56 helps maintain a deflated tube 12 in a more open shape, as shown in FIG. 4. In some cases, the deflated air volume in tube 12 (FIG. 4) is at least 70% of the inflated volume in tube 12 (FIG. 3), thus the minimal change in air volume reduces the popping sound if tube 12 is suddenly inflated. Favorable aesthetics are also provided.

Figure 18:
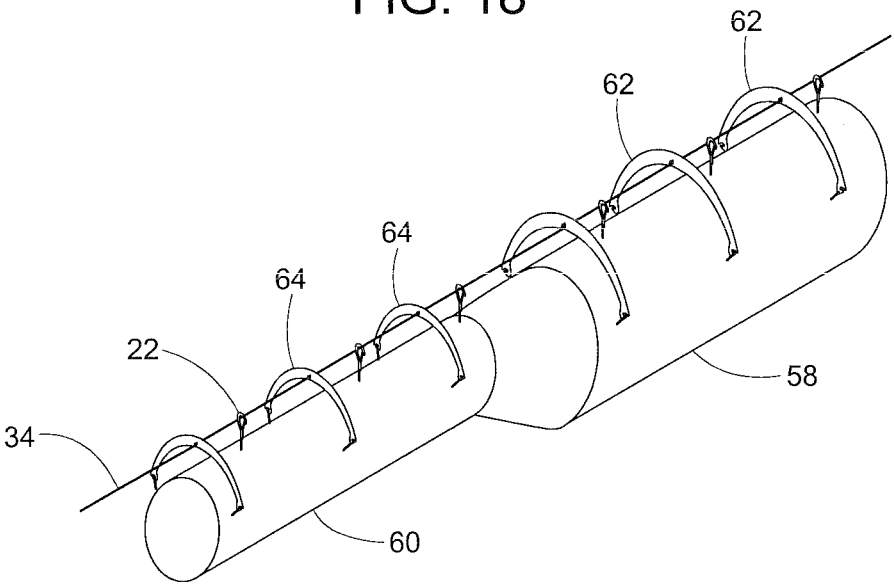
FIG. 18 is a perspective view showing another inflated air duct assembly.

Air duct assembly 10 is particularly useful in situations where a large diameter tube 58 feeds a smaller diameter tube 60, as shown in FIG. 18. In this case, a single suspension line 34 can be used for supporting both ducts 58 and 60. A plurality of relatively large hangers 62 can support tube 58, and a plurality of relatively small hangers 64 can support tube 60.

Although the invention is described with respect to various embodiments, modifications thereto will be apparent to those of ordinary skill in the art. The scope of the invention, therefore, is to be determined by reference to the following claims:

What is claimed is:

1. An air duct assembly, comprising:

an inflatable tube defining an air passageway therethrough;

a support structure defining a line centrally disposed above the inflatable tube;

a plurality of hangers attached to the support structure to be above the inflatable tube, each of the plurality of hangers having a longitudinal length extending in a direction traversing the line centrally disposed above the inflatable tube, the plurality of hangers including a hanger having a first end of the longitudinal length coupled to a first point of the inflatable tube and a second end of the longitudinal length coupled to a second point of the inflatable tube, the first point located within a first portion of the tube extending along a length of the tube, the second point located within a second portion of the tube extending along the length of the tube, the tube being solely formed from a unitary pliable material at the first and second portions; and a plurality of connectors attached to the support structure, the plurality of connectors being structurally different from the plurality of hangers, the plurality of connectors including a connector coupled to a third point within a third portion of the inflatable tube extending along the length of the tube, the third portion being spaced-apart from the first and second portions, the plurality of hangers and the plurality of connectors being distributed in an alternating pattern along the line.

2. The air duct assembly of claim 1, wherein the support structure includes a suspension line, the hanger defining a line-receiving slot, and the suspension line extending into the line-receiving slot.

3. The air duct assembly of claim 2, further including a stopper attached to the hanger in proximity with the line-receiving slot to help contain the suspension line within the line-receiving slot.

4. The air duct assembly of claim 1, wherein the inflatable tube includes a relatively large diameter tube and a relatively small diameter tube, the plurality of hangers includes a plurality of relatively large hangers and a plurality of relatively small hangers, the relatively large hangers supporting the relatively large diameter tube, the relatively small hangers supporting the relatively small diameter tube, and the support structure supporting both the relatively large hangers and the relatively small hangers.

5. The air duct assembly of claim 1, wherein the inflatable tube has an inflated volume when inflated and a deflated volume when deflated, the deflated volume being at least 70% of the inflated volume.

6. An air duct assembly, comprising:

an inflatable tube defining an air passageway therethrough, the inflatable tube having a longitudinal length defining a lengthwise direction; and a suspension system including hangers connected to the inflatable tube solely at ones of a plurality of points on the inflatable tube, each of the hangers to be spaced apart from portions of the inflatable tube extending between the ones of the plurality of points to which each hanger is connected, the plurality of points corresponding to a first lateral set of points spaced apart in the lengthwise direction along the longitudinal length of the inflatable tube, a second lateral set of points spaced apart in the lengthwise direction along the longitudinal length of the inflatable tube, and a central set of points spaced apart in the lengthwise direction along the longitudinal length of the inflatable tube, the central set of points to be staggered out of alignment with the first and second lateral sets of points in the lengthwise direction, the central set of points to be closer to a top of the inflatable tube than the first and second lateral sets of points, the first and second lateral sets of points to be above a midpoint of the inflatable tube, the inflatable tube being formed of a flexible material to include a flexible cross-sectional shape at corresponding points of the first and second lateral sets of points connected to a first one of the hangers.

7. The air duct assembly of claim 6, wherein the central set of points are above the first and second lateral sets of points.

8. The air duct assembly of claim 6, wherein the inflatable tube includes a pliable sheet completely encircling the air passageway.

9. The air duct assembly of claim 6, wherein the inflatable tube has an inflated volume when inflated and a deflated volume when deflated, the deflated volume being at least 70% of the inflated volume.

10. A method of suspending an inflatable tube from a support structure, wherein the inflatable tube has a length and an interior air passageway, the method comprising:

providing the inflatable tube which has a first lateral set of points and a second lateral set of points at an exterior surface of the inflatable tube, the first lateral set of points distributed in a longitudinal direction along the length of the inflatable tube, the second lateral set of points distributed in the longitudinal direction along the length of the inflatable tube, portions of the tube being unitary pliable material at the first and second lateral sets of points along the length of the inflatable tube, wherein the first lateral set of points and the second lateral set of points are lower than a top central portion of the inflatable tube extending in the longitudinal direction along the length of the inflatable tube, the inflatable tube having a third set of points at the exterior surface of the inflatable tube and distributed along the top central portion of the inflatable tube;

suspending a plurality of lateral supports from the support structure such that the plurality of lateral supports are spaced-apart along the length of the inflatable tube, each of the lateral supports positioned to traverse the longitudinal direction along the length of the inflatable tube;

connecting one of the plurality of lateral supports to one point of each of the first and second lateral sets of points corresponding to a single cross-section of the inflatable tube associated with a location where the one lateral support traverses the inflatable tube, wherein a shape of the single cross-section is different when the tube is inflated relative to when the tube is not inflated; and coupling at least one of the third set of points to the support structure via at least a connector, the connector being different from the lateral supports.

11. The air duct assembly of claim 6, wherein the first lateral set of points, the second lateral set of points, and the central set of points are located at different circumferential positions from one another on the inflatable tube.

12. The air duct assembly of claim 2, wherein the hanger includes a generally arcuate arm formed of sheet metal disposed substantially perpendicular to the suspension line.

13. The air duct assembly of claim 1, wherein the first and second portions are integral to the inflatable tube.

14. The air duct assembly of claim 13, further including rings to couple the first and second portions to the hanger, each ring having a D-shape.

15. The air duct assembly of claim 1, further including straps to couple the first and second portions to the hanger.

16. The air duct assembly of claim 1, wherein the pliable material is to hang freely below the first and second points where the first and second ends are coupled.

17. The air duct assembly of claim 6, wherein the first hanger defines a slot that opens to an edge of the first hanger, a suspension wire associated with the suspension system to extend through the slot to support the first hanger.

18. The method of claim 10, wherein the one of the plurality of lateral supports hangs substantially vertically from the support structure above the one point of each of the first and second lateral sets of points.

19. The method of claim 10, wherein the inflatable tube at the single cross-section is solely supported at the one point of each of the first and second lateral sets of points by the one of the plurality of lateral supports.

20. The air duct assembly of claim 1, wherein ones of the plurality of hangers are positioned substantially at a mid-point between adjacent ones of the plurality of connectors.

* * * * *